US007070127B2

(12) United States Patent
Maier

(10) Patent No.: US 7,070,127 B2
(45) Date of Patent: Jul. 4, 2006

(54) FUEL INJECTION VALVE WITH A FILTER BUSH

(75) Inventor: Dieter Maier, Isle of Palms, SC (US)

(73) Assignee: Robert Bosch GmbH, Stuttgart (DE)

( * ) Notice: Subject to any disclaimer, the term of this patent is extended or adjusted under 35 U.S.C. 154(b) by 121 days.

(21) Appl. No.: 10/258,698

(22) PCT Filed: Feb. 27, 2002

(86) PCT No.: PCT/DE02/00691

§ 371 (c)(1),
(2), (4) Date: Apr. 22, 2003

(87) PCT Pub. No.: WO02/068816

PCT Pub. Date: Sep. 6, 2002

(65) Prior Publication Data

US 2003/0155445 A1 Aug. 21, 2003

(30) Foreign Application Priority Data

Feb. 28, 2001 (DE) ..... 101 09 410

(51) Int. Cl.
*B05B 1/30* (2006.01)
*F02M 39/00* (2006.01)
*F02M 61/10* (2006.01)

(52) U.S. Cl. ..... 239/585.1; 239/585.3; 239/585.4; 239/585.5; 239/533.11; 239/88

(58) Field of Classification Search .. 239/585.1–585.5, 239/533.2, 533.3, 533.9, 533.11, 88–93; 251/129.15, 129.21, 127
See application file for complete search history.

(56) References Cited

U.S. PATENT DOCUMENTS

| | | | | |
|---|---|---|---|---|
| 5,340,032 | A | 8/1994 | Stegmaier et al. | |
| 5,692,723 | A * | 12/1997 | Baxter et al. | 251/129.21 |
| 5,921,475 | A | 7/1999 | DeVriese | |
| 6,070,813 | A * | 6/2000 | Durheim | 239/533.2 |
| 6,328,232 | B1 * | 12/2001 | Haltiner et al. | 239/585.1 |

FOREIGN PATENT DOCUMENTS

| | | |
|---|---|---|
| DE | 43 25 842 | 2/1995 |
| DE | 197 52 834 | 6/1999 |
| EP | 0 697 064 | 2/1996 |
| EP | 1 072 786 | 1/2001 |
| JP | 62 032 276 | 2/1987 |

* cited by examiner

*Primary Examiner*—Davis Hwu
(74) *Attorney, Agent, or Firm*—Kenyon & Kenyon LLP

(57) ABSTRACT

A fuel injector for fuel-injection systems of internal combustion engines has a solenoid coil; a valve needle that is mechanically linked to the solenoid coil and acted upon by a restoring spring in a closing direction, in order to actuate a valve-closure member which, together with a valve-seat face, forms a sealing seat; and a sleeve, which prestresses the restoring spring. The sleeve is integrally formed with a filter element to form a one-part, deep-drawn filter sleeve, which has through-flow openings for filtering the fuel flowing through the fuel injector.

5 Claims, 2 Drawing Sheets

FUEL INJECTION VALVE WITH A FILTER BUSH

FIELD OF THE INVENTION

The present invention relates to a fuel injector.

BACKGROUND INFORMATION

In the case of fuel injectors already known, fuel filters are press-fit into a fuel intake nipple and, thus, secured in place in it. This manner of fastening involves the risk of dust and cuttings forming, which can lead to the malfunction of the fuel injector. In addition, retaining collars for upper sealing rings are constructed as individual component parts.

A fuel injector, in which a fuel filter is manufactured in one piece with a retaining collar, is already known from German Published Patent Application No. 43 25 842. The retaining collar radially extends beyond the fuel intake nipple and has a lip outside the fuel intake nipple. The circumferential lip of the retaining collar forms, together with a groove on the outer circumference of the fuel intake nipple, a snap-in connection, by which the fuel filter is fastened in a defined manner. There is only a clearance fit between the base of the fuel filter and the inner wall of the fuel intake nipple, so that any build-up of shavings in the interior of the fuel injector is prevented.

In addition, European Patent No. 0 697 064 describes a filter, which is for a fuel injector having central fuel delivery and is form-locked to an adjusting sleeve for a restoring spring that keeps the fuel injector closed in the rest state. In this context, the filter is made out of a plastic frame, over which a mesh grating is laid. The filter is connected to the adjusting sleeve with the aid of a snap-in fastener, the adjusting sleeve preferably being made of metal. This allows the static rate of flow through the fuel injector to also be calibrated after the filter is inserted.

A particular disadvantage of the fuel injectors known from the above-mentioned, printed publications is the large amount of processing time spent in attaching the filter to either the adjusting sleeve or the fuel intake nipple. In addition, the filter and adjusting sleeve are made of different materials, whereby cuttings and dust are formed at the contact surfaces, predominantly on the plastic of the filter, which can lead to the malfunction of the fuel injector caused by the deposition of the particles.

SUMMARY OF THE INVENTION

The fuel injector of the present invention has the advantage over the background art that the sleeve for adjusting the dynamic flow rate is formed in one piece with the filter element, and therefore, on one hand, the position of the sleeve may easily be adjusted using the protruding filter element, and, on the other hand, quick and inexpensive manufacturing and assembly are rendered possible.

In this context, the combined filter sleeve is inexpensively manufactured by deep-drawing, so that a plastic frame having a filter grating attached to it may be dispensed with.

Through-flow openings are preferably provided, which may be introduced in large numbers into the filter sleeve in an exact manner, using laser drilling.

In particular, it is also advantageous that the flow rate may be adjusted with the filter already inserted, since contamination of the valve interior may be prevented by the adjusting tools.

Furthermore, it is advantageous that the filter sleeve may also be removed again, if necessary.

DETAILED DESCRIPTION

Figure 1:
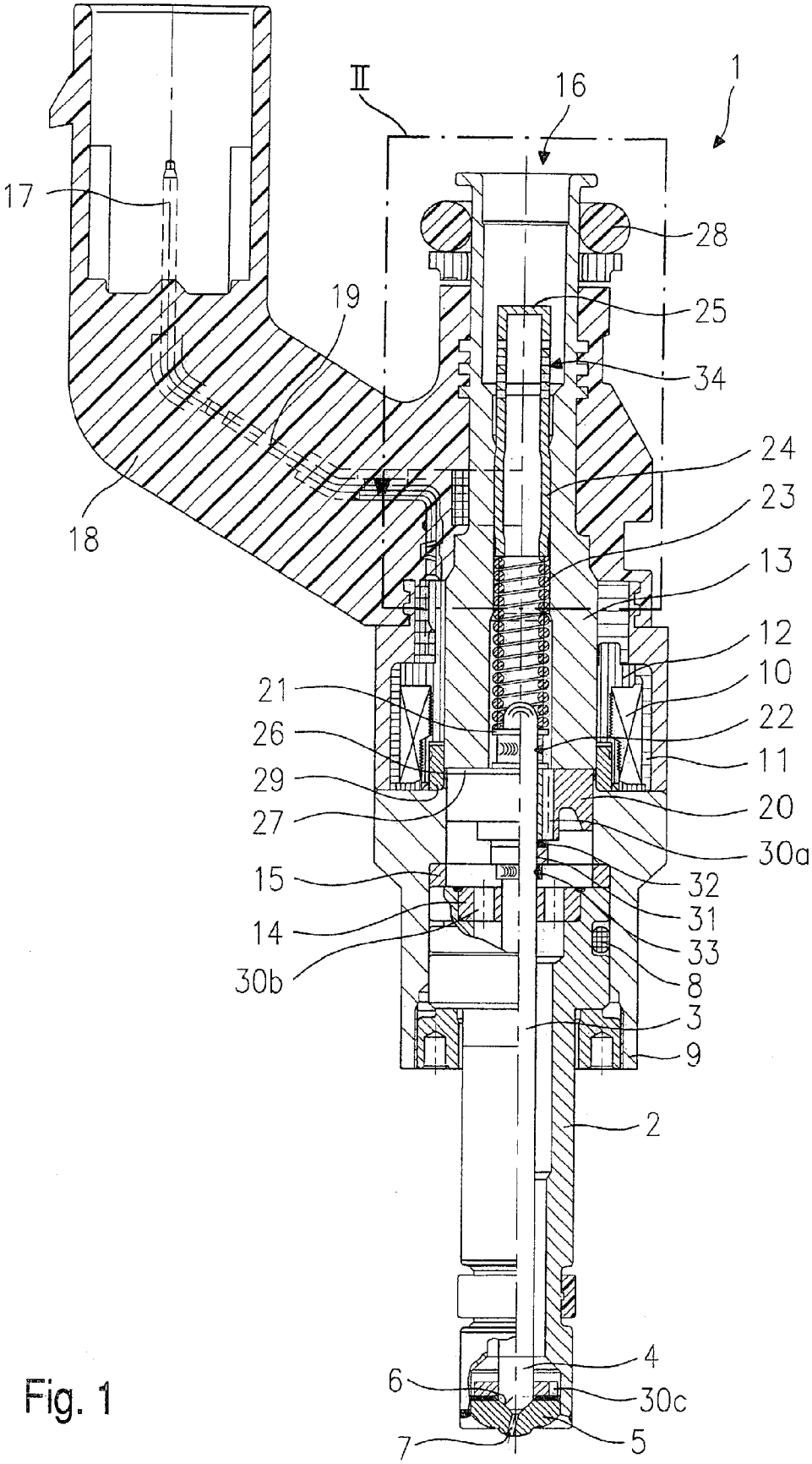
FIG. 1 shows a schematic of a section through an exemplary embodiment of a fuel injector constructed according to the present invention.

A fuel injector 1 is designed, for example, in the form of an injection valve for fuel-injection systems of mixture-compressing, spark ignition engines. The fuel injector 1 represented is suitable for the direct injection of fuel into a combustion chamber, not shown, of an internal combustion engine. However, the present invention is also similarly suitable in the case of fuel injectors 1 for the injection of fuel into an intake manifold of the engine.

Fuel injector 1 includes a nozzle body 2, in which a valve needle 3 is guided. Valve needle 3 is mechanically linked to a valve-closure member 4, which interacts with a valve-seat surface 6 positioned on a valve-seat member 5, to form a sealing seat. The fuel injector 1 in the exemplary embodiment is an inwardly opening fuel injector 1, which has a spray orifice 7. Nozzle body 2 is sealed from an outer pole 9 of a solenoid coil 10 by a seal 8. Solenoid coil 10 is encapsulated in a coil housing 11 and wound onto a coil brace 12, which lies against an inner pole 13 of solenoid coil 10. Inner pole 13 and outer pole 9 are separated from each other by a gap 26 and are braced on a connecting member 29. Solenoid coil 10 is energized via an electric line 19, by an electric current which may be supplied via an electrical plug contact 17. A plastic jacket 18, which may be injection-molded onto inner pole 13, encloses plug contact 17.

Valve needle 3 is guided in a valve-needle guide 14, which is disk-shaped. A paired adjustment disk 15 is used to adjust the lift. An armature 20 is situated on the other side of adjustment disk 15. The former is frictionally connected by a flange 21 to a valve needle 3, which is joined to flange 21 by a welded seam 22.

A restoring spring 23, which, in the present design of fuel injector 1, is prestressed by a sleeve 24, is braced against flange 21. According to the present invention, the sleeve 24 that takes the form of an adjustment sleeve is formed in one piece with a filter element 25. The component part formed in this manner is subsequently referred to as filter sleeve 34. In this context, the filtering action is produced by through-flow openings 35, which are introduced in an inflow end 36 of filter sleeve 34. A discharge end 37 of filter sleeve 34 is formed in such a manner, that it may be used to adjust the initial spring tension of restoring spring 23, and thus, to adjust the static rate of flow through fuel injector 1. A detailed description of filter sleeve 34 may be gathered from the description relating to FIG. 2.

Fuel channels 30*a* through 30*c*, which direct the fuel supplied via a central fuel inlet 16 to spray-discharge opening 7, run in valve-needle guide 14, in armature 20, and on valve-seat member 5. A seal 28 seals fuel injector 1 from a receiving bore pole, which is not shown in further detail and is, for example, in a fuel rail.

In the rest state of fuel injector 1, armature 20 is acted upon by restoring spring 23 in a direction opposite to its lift direction, in such a manner, that valve-closure member 4 is held against valve seat 6 so as to create a seal. When solenoid coil 10 is excited, it generates a magnetic field which moves armature 20 in the lift direction, counter to the spring force of restoring spring 23, the lift being given by a working gap 27 occurring in the rest position, between inner pole 13 and armature 20. Flange 21, which is welded to valve needle 3, is also taken along by armature 20 in the lift direction. Valve-closure member 4, which is mechanically linked to valve needle 3, lifts off from the valve-seat surface, and fuel is discharged through spray-discharge opening 7.

If the coil current is switched off, armature 20 falls away from inner pole 13 after sufficient decay of the magnetic field, due to the pressure of restoring spring 23, whereupon flange 21, which is mechanically linked to valve needle 3, moves in a direction counter to the lift direction. Valve needle 3 is thereby moved in the same direction, whereby valve-closure member 4 sets down on valve seat surface 6, and fuel injector 1 is closed.

Figure 2:
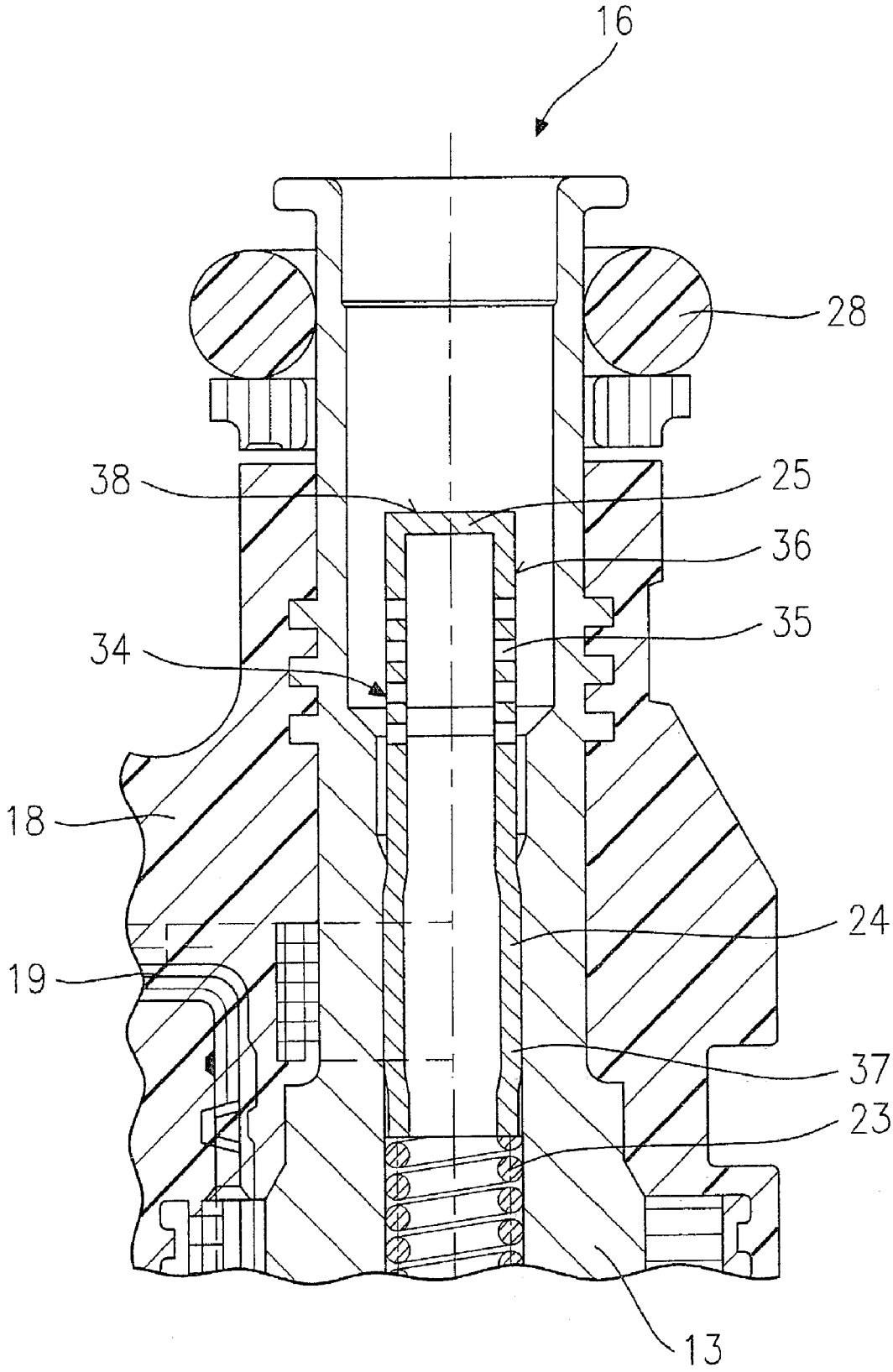
FIG. 2 shows an excerpt from region II of a schematic section through the exemplary embodiment represented in FIG. 1.

In an excerpt of a cross-sectional view, FIG. 2 shows the detail of fuel injector 1 of the present invention, which is designated in FIG. 1 by II.

As mentioned previously, filter sleeve 34 is constructed such that through-flow openings 35 are formed at inflow end 36, while discharge end 37 is formed in the shape of a sleeve, so that the initial tension of restoring spring 23 may be varied by pushing filter sleeve 34 into fuel injector 1.

In this context, filter sleeve 34 is preferably formed out of metal, in order to ensure permanent clamping action during the entire service life of fuel injector 1. The manufacturing is accomplished by deep-drawing, a manufacturing method that is simple and cost-effective.

In order to avoid high manufacturing costs for filter region 25 of filter sleeve 34, small-diameter through-flow openings 35 are introduced in large numbers into inflow end 36 of filter sleeve 34. This is preferably accomplished by laser drilling, since it allows extremely fine, low-volume bore holes to be produced. The diameter of through-flow openings 35 is preferably 0.04 to 0.05 mm, which means that dirt particles in the fuel may be filtered out to a satisfactory extent. In this context, the number of through-flow openings 35 depends on the available surface of filter region 25. For example, the number of through-flow openings 35 may be increased by lengthening filter sleeve 34 or utilizing the surface of an inflow-side cover plate 38 of filter sleeve 34.

In this manner, the interior of fuel injector 1 may be protected in two ways against contaminants that may cause malfunctions during the operation of fuel injector 1. On one hand, the dynamic flow rate is adjusted by moving filter sleeve 34 when filter 25 is already installed, so that dirt from the adjusting tool may not reach the interior of the valve. On the other hand, cuttings and dust escape in response to filter 25 being pressed in at the end of the production line, whereby malfunctions caused by deposition of dust or larger particles are likewise prevented.

Combined filter sleeve 34 also allows the dynamic flow through fuel injector 1 to be adjusted in a simpler and more rapid manner. First of all, due to its greater overall length, filter sleeve 34 extends so far upstream into central fuel inlet 16, that it may be moved, or if need be, removed more easily. On the other hand, filter sleeve 34 is situated considerably closer to the valve group after adjustment of the flow rate, so that the surface between filter sleeve 34 and the valve group becomes smaller, and the risk of contamination therefore decreases.

The present invention is not limited to the exemplary embodiments represented and is suitable for any designs of fuel injectors 1, e.g. for manifold injectors 1 or fuel injectors 1 connected to a common-rail system.

What is claimed is:

1. A fuel injector for a fuel-injection system of an internal combustion engine, comprising:

a solenoid coil;

a restoring spring;

a valve-closure member;

a valve-seat face that forms a sealing seat with the valve-closure member;

a valve needle that is operatively linked to the solenoid coil and acted upon by the restoring spring in a closing direction in order to actuate the valve-closure member;

a sleeve that prestresses the restoring spring; and a filter element that is integrally formed with the sleeve to form a one-part, deep-drawn filter sleeve that includes directly in a wall thereof through-flow openings for filtering a fuel flowing through the fuel injector.

2. The fuel injector as recited in claim 1, wherein:

the through-flow openings are introduced in an inflow-side end of the filter sleeve.

3. The fuel injector as recited in claim 1, wherein:

the through-flow openings are introduced into the filter sleeve using laser drilling.

4. The fuel injector as recited in claim 1, wherein:

diameters of the through-flow openings are 0.04 mm to 0.05 mm.

5. The fuel injector as recited in claim 1, wherein:

a discharge end of the filter sleeve is formed in such a manner that a variable, initial tension may be applied to the restoring spring by moving the filter sleeve.

* * * * *